US008758204B2

(12) United States Patent
Cappellano

(10) Patent No.: US 8,758,204 B2
(45) Date of Patent: Jun. 24, 2014

(54) PHYSICAL FITNESS TRAINING SYSTEM

(76) Inventor: Robert Cappellano, Burnaby (CA)

( * ) Notice: Subject to any disclaimer, the term of this patent is extended or adjusted under 35 U.S.C. 154(b) by 350 days.

(21) Appl. No.: 13/088,359

(22) Filed: Apr. 16, 2011

(65) Prior Publication Data

US 2011/0312476 A1 Dec. 22, 2011

Related U.S. Application Data

(60) Provisional application No. 61/325,209, filed on Apr. 16, 2010.

(51) Int. Cl.
*A63B 21/00* (2006.01)

(52) U.S. Cl.
USPC ..... 482/121; 428/126; 428/124; 428/49

(58) Field of Classification Search
USPC ..... 482/49, 148, 120, 124, 121
See application file for complete search history.

(56) References Cited

U.S. PATENT DOCUMENTS

| | | | | |
|---|---|---|---|---|
| 4,684,122 A * | 8/1987 | Desmond et al. | ..... | 482/105 |
| 6,245,001 B1 * | 6/2001 | Siaperas | ..... | 482/142 |
| 8,202,205 B2 * | 6/2012 | Reade | ..... | 482/124 |

* cited by examiner

*Primary Examiner* — Jerome w Donnelly
(74) *Attorney, Agent, or Firm* — Island IP Law; Stephen R. Burri

(57) ABSTRACT

A portable exercise apparatus comprising one or more planar arm supports for supporting one or both of a user's forearms; strapping means for securing each arm support to the user's forearms; one or more elastomeric cords attachable between each planar arm support and one or more anchor points; and anchor means for securing each elastomeric cord to the anchor points. The apparatus may be used for pectoral exercises, core muscle exercises, and other exercises.

4 Claims, 10 Drawing Sheets

PHYSICAL FITNESS TRAINING SYSTEM

FIELD OF THE INVENTION

The present invention relates to physical fitness training. In particular, it relates to an apparatus and methods for physical fitness training.

BACKGROUND OF THE INVENTION

It is known to provide physical fitness training apparatus for exercise and body building. A wide variety of apparatus are known, including free weights and exercise machinery.

It is also known to provide, as a component of such prior art machinery, apparatus for exercising and developing the muscles of the chest known as the pectoralis major muscles ("pecs") which extend from the centre of the chest outwardly to each shoulder, as shown in FIG. 1.

A common form of pec building apparatus is also depicted in FIG. 1. This equipment design requires the user to take a seated position between two elevated weight-bearing members. The user draws the weight-bearing members together along an arced path by contracting the pecs, and then releases the weight-bearing members by extending the pecs.

It would be desirable to have a system for developing the pecs which did not require a large, stationary piece of body-building equipment, but rather was lightweight, compact, portable and versatile to permit exercise of the pectoralis major muscle group in a more convenient manner. The fitness apparatus of the present invention achieves these objectives.

SUMMARY OF THE INVENTION

There is provided an exercise apparatus comprising anchor means reversibly connectable to a fixed location, resistance means connectable to the anchor means, arm support means connected to the resistance means, and fastening means for securing the arm support means to a user.

The anchor means may be a clip for attachment of the anchor means to an anchor point. The resistance means may be elastomeric cords, each attachable at a first end to the anchor means, and at a second end to the arm support means. The arm support means may be planar arm supports, each planar arm support attachable to a corresponding elastomeric cord. The fastening means may be one or more adjustable straps attachable to each planar support.

The invention may be used to perform a pectoral fly exercise in a standing position, and an abdominal crunch exercise with resistance in a supine position, as well as other exercises.

The arm support may be manufactured of one or more ethyl vinyl acetate foams, or it may be manufactured of a foam comprised of a polyethylene/ethyl vinyl acetate mixture.

Each arm support may further comprises opposing lateral walls along a portion of its length for providing lateral arm support to a user, and gripping means for allowing a user to clasp the arm support with a hand. The gripping means may be an opening in each arm support for insertion therethrough of the user's fingers, or a handle.

In another aspect, the invention provides a portable exercise apparatus comprising one or more planar arm supports for supporting one or both of a user's forearms; strapping means for securing each arm support to the user's forearms; one or more elastomeric cords attachable between each planar arm support and one or more anchor points; and anchor means for securing each elastomeric cord to the anchor points.

BRIEF DESCRIPTION OF THE DRAWINGS

A detailed description of the preferred embodiments is provided below by way of example only and with reference to the following drawings, in which.

Figure 1:
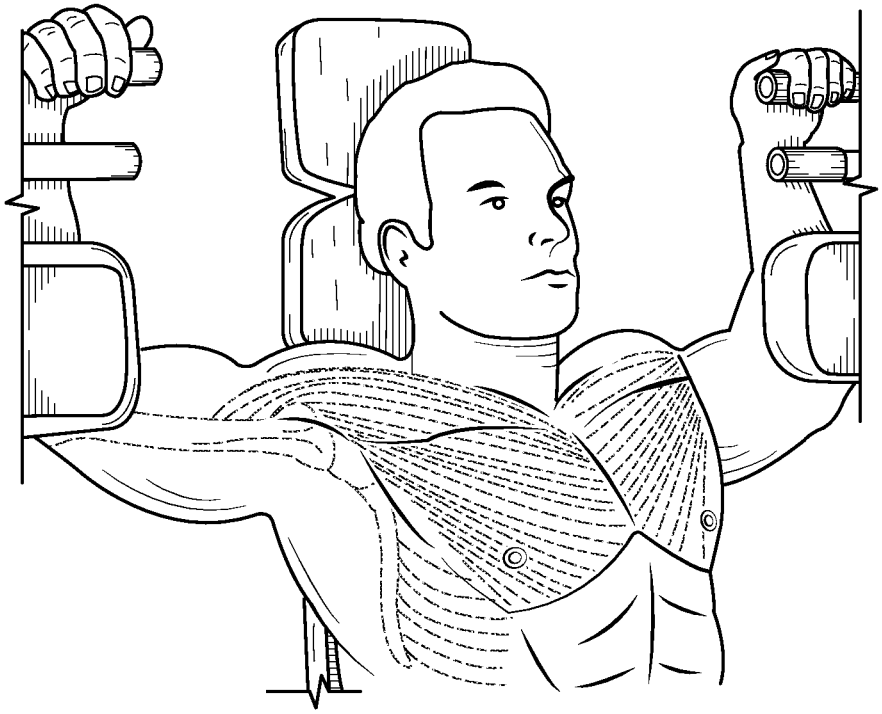
FIG. 1 depicts use of a prior art apparatus for developing the pectoralis major muscles.

In the drawings, one embodiment of the invention is illustrated by way of example. It is to be expressly understood that the description and drawings are only for the purpose of illustration and as an aid to understanding, and are not intended as a definition of the limits of the invention.

DETAILED DESCRIPTION OF THE INVENTION

The present invention comprises a convenient piece of fitness equipment that provides the opportunity to perform the fly movement at a different rate of resistance in an isokinetic contraction. The apparatus of the present invention stimulates and shapes the muscles of the chest, and also contributes to increasing the size of the pectoralis major and pectoralis minor muscles, without causing any harm to the user.

The apparatus of the present invention enables the user to perform the exercise movement in the horizontal plane. As a result, it is simple to use and comfortable on the user's body, thereby playing a vital and important role in strengthening and shaping the user's chest. In addition, by using the apparatus of the present invention with different types of body movement, the apparatus may be used to exercise and develop various muscles of the body, including the gluteus maximus, hip muscles, leg muscles, and abdominal muscles. Its easy to use design allows the user to effortlessly change its resistance to the user's personal preference to reach their individual goals. Whether used in home, at work, at the park, or even while traveling, its compact design allows for easy maneuverability.

Figure 2A:
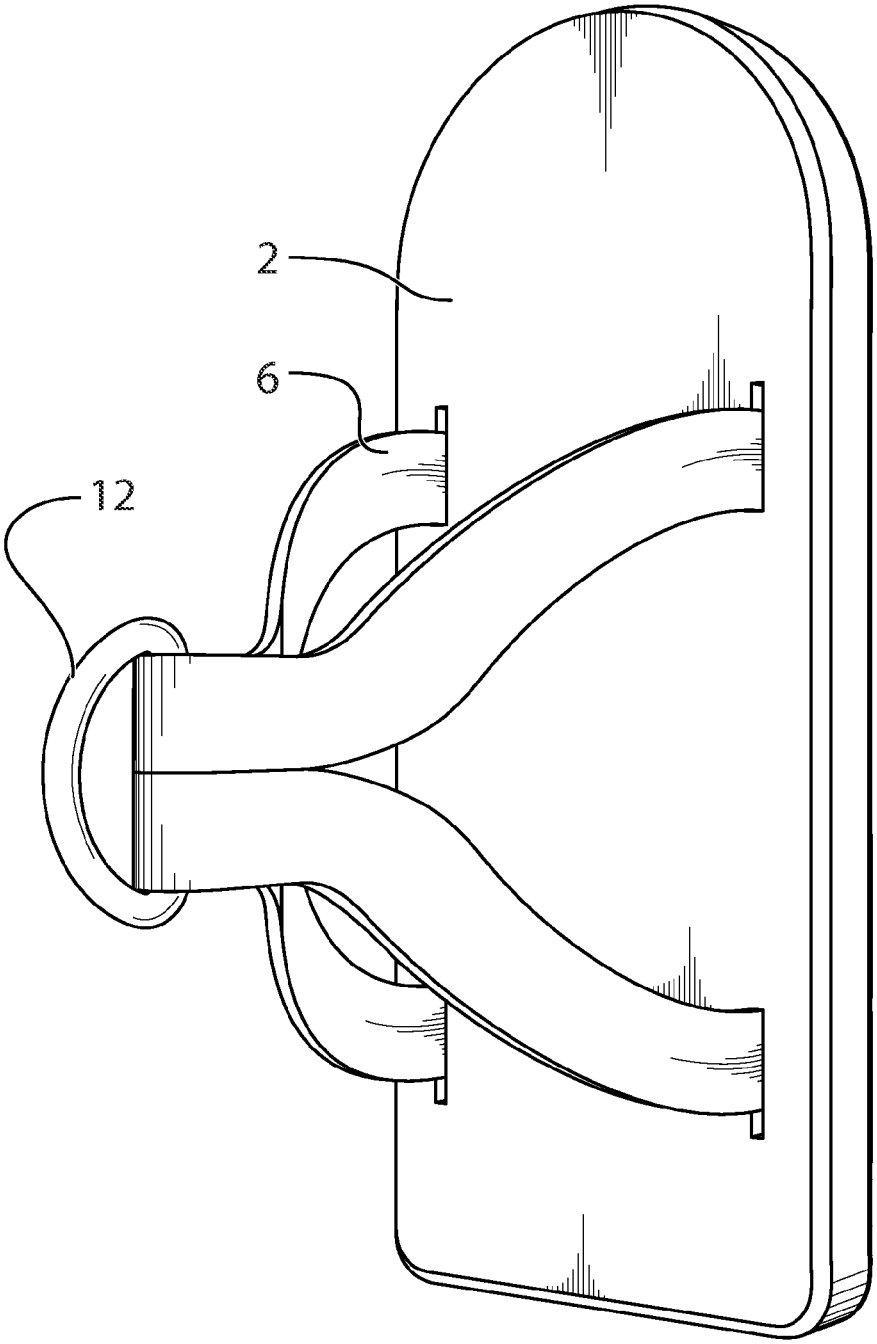
FIGS. 2A-D depict the apparatus of the present invention.
Figure 2B:
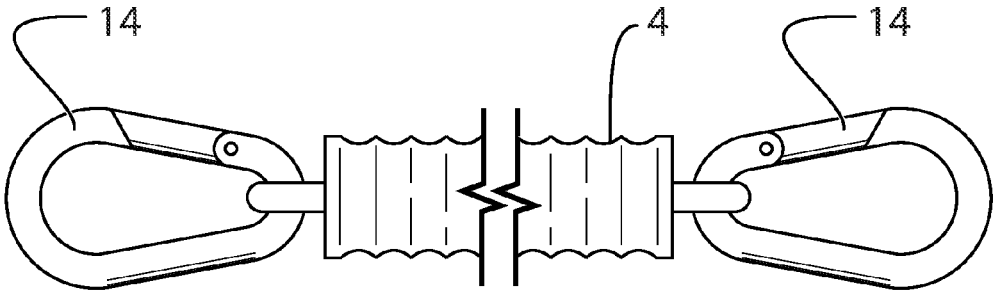
Figure 2C:
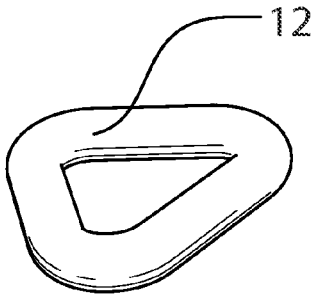
Figure 2D:
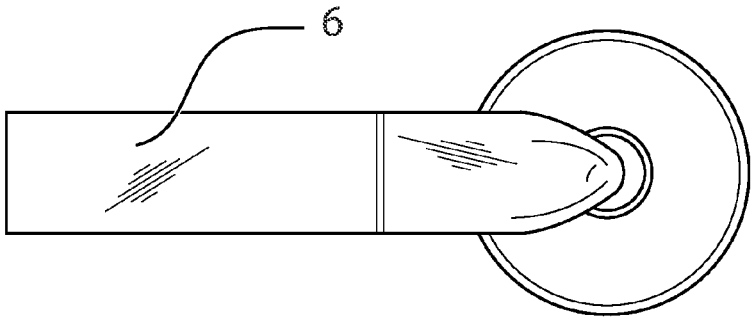
Figure 3:
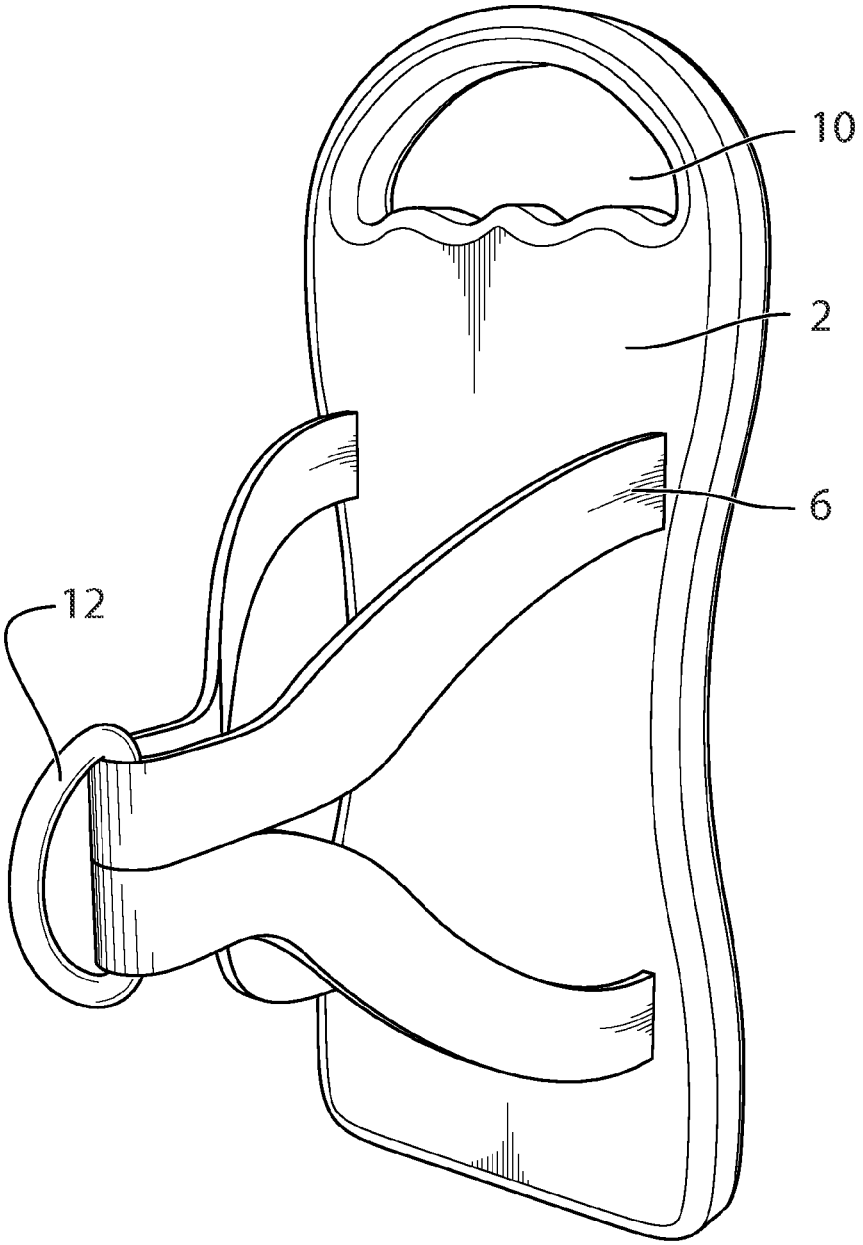
FIG. 3 is a perspective view of one embodiment of the present invention depicting a contoured arm support.

As depicted in FIG. 2A, the apparatus of the present invention comprises one or more arm supports 2 each connectable to an elastic cord 4. Each arm support is of a size and shape to provide a surface against which a user's forearm may be placed. Each arm support preferably is approximately 6 inches wide and approximately sixteen inches long, although other dimensions are also possible provided they dimensions are sufficient to provide support to a user's forearm. The shape of each arm support may also be varied to provide improved comfort and support, and to minimize the amount of material required, as depicted in FIG. 3.

The arm supports are preferably manufactured of a lightweight material which is able to repel moisture from sweat, and which is very durable and easily cleaned with soap and water. Preferably, the material used for the arm supports is moldable to allow the arm supports to mold to the user's forearms for added support. A preferred material is non-toxic polyethylene/ethyl vinyl acetate ("PE/EVA") foam, although other materials including certain plastics and fabric or foam covered wood or metal are also possible.

Figure 4:
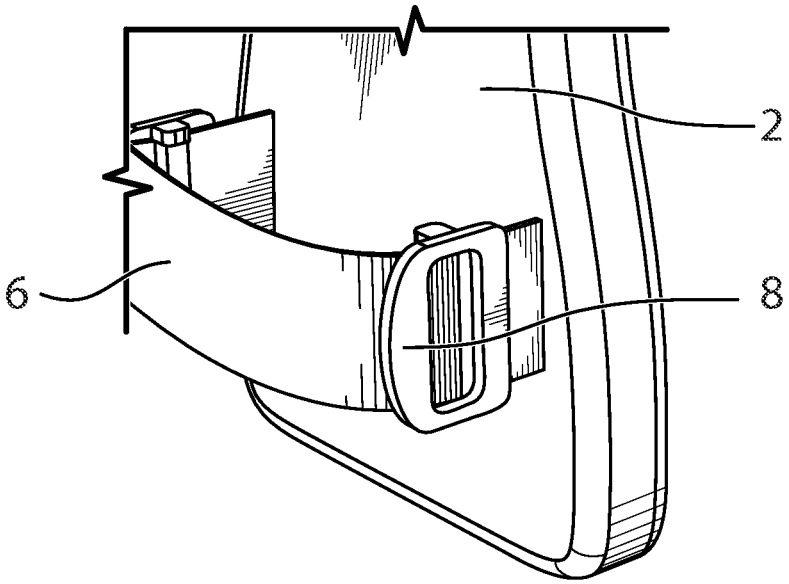
FIG. 4 is a perspective view of one embodiment of the adjustable strapping of the present invention.
Figure 5:
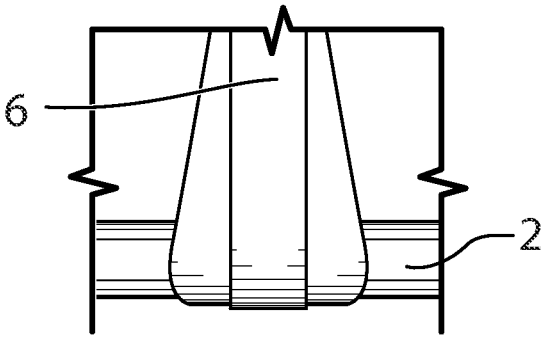
FIG. 5 is a perspective view of one embodiment of the present invention depicting side enclosures on the arm supports.

Each arm support is provided with strapping 6 to connect the arm support to the elastic cord stretchable from the arm supports. The strapping is preferably 1 inch to 1.5 inches wide, although other widths are also possible. The strapping also provides support for the forearms, assisting in maintaining the forearm position on the arm support. As shown in FIG. 4, preferably, strap adjustment means 8 are provided on the strapping to enable the user to adjust the strapping to the dimensions of their arms. In one embodiment, the strapping may be significantly wider than 1.5 inches to provide lateral support to the forearms. In yet another embodiment shown in FIG. 5, the arm supports may further include side supports to provide lateral supports to the forearms. The strapping may be a canvas-type material or other strong fabric with length adjustment means. Alternatively, the strapping may include Velcro fastening means to allow easy length adjustment.

Figure 6:
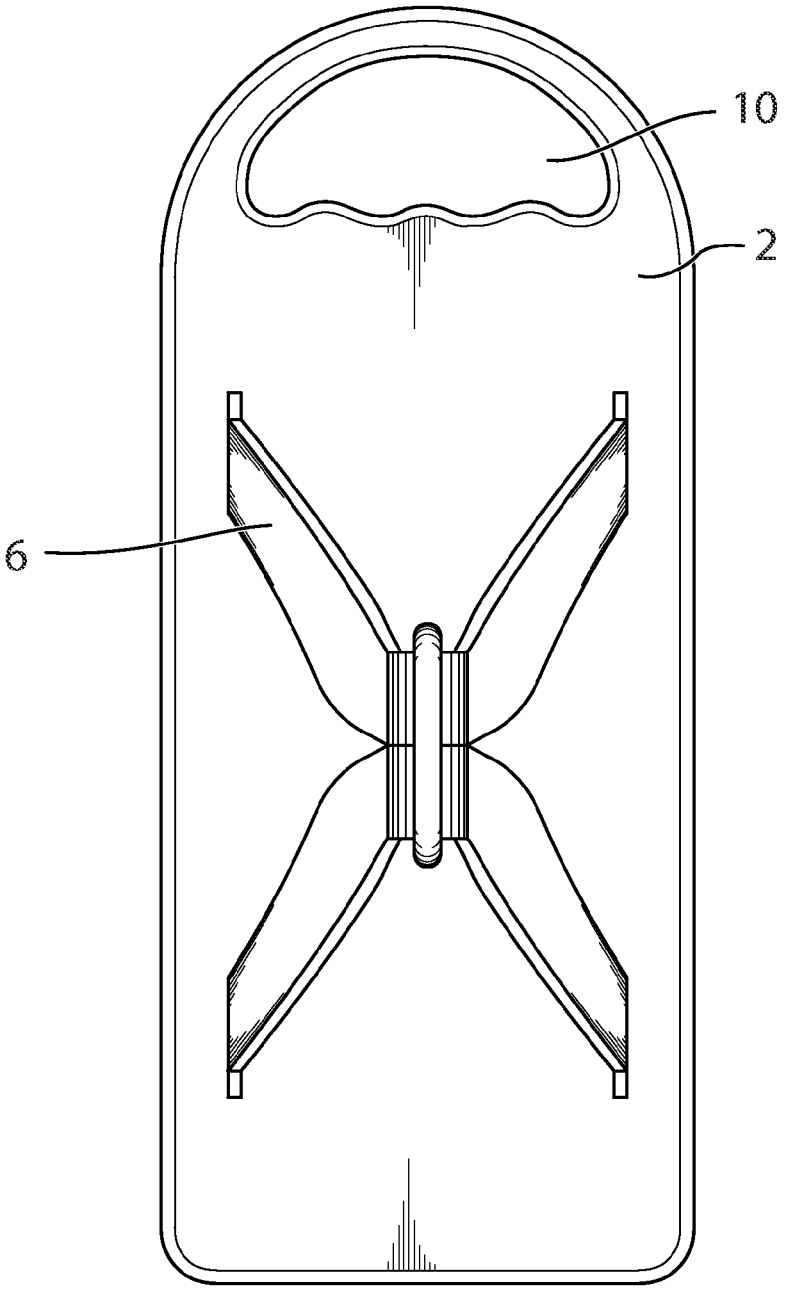
FIG. 6 is a perspective view of one embodiment of the present invention depicting finger contours.

In the preferred embodiment, the arm supports include one or more openings 10 near one end for placement therethrough of one or more fingers of the user's hands, as seen in FIG. 6. The opening may further include contours for the placement and support of individual fingers. In an alternative embodiment, the arm support may instead include finger contours along one end instead of an opening. In yet another embodiment, the finger grip may be achieved with a channel for insertion of the fingers having a single opening near or at one end of the arm support.

The apparatus of the invention also comprises connection means 12 for connecting the strapping to an elastic cord stretchable between the arm supports. The elastic cord may also be directly attachable to the arm support. Preferably, the connection means is a triangular ring enabling ease of connection of the elastic cord thereto using clips 14 connected to the ends of the elastic cord. The triangular shape is preferred to limit movement of the elastic cord within the connection ring, but other shapes, including circular connection rings, are possible. Preferably, the connection means is manufactured of a strong metal such as steel, but other strong materials are also possible.

In a preferred embodiment, the invention further comprises anchor means for attachment of the elastic cord to a fixed point which provides the resistance to the user. The invention preferably comprises one elastic cord for use with each arm support, each elastic cord connectable to the anchor means. However, it is also possible to connect the arm supports to opposing ends of a single elastic cord and to connect the elastic cord to anchor means at a midpoint of the elastic cord, or to run the elastic cord around a fixed anchor point such as a tree or pole which provides the resistance required.

Figure 13:
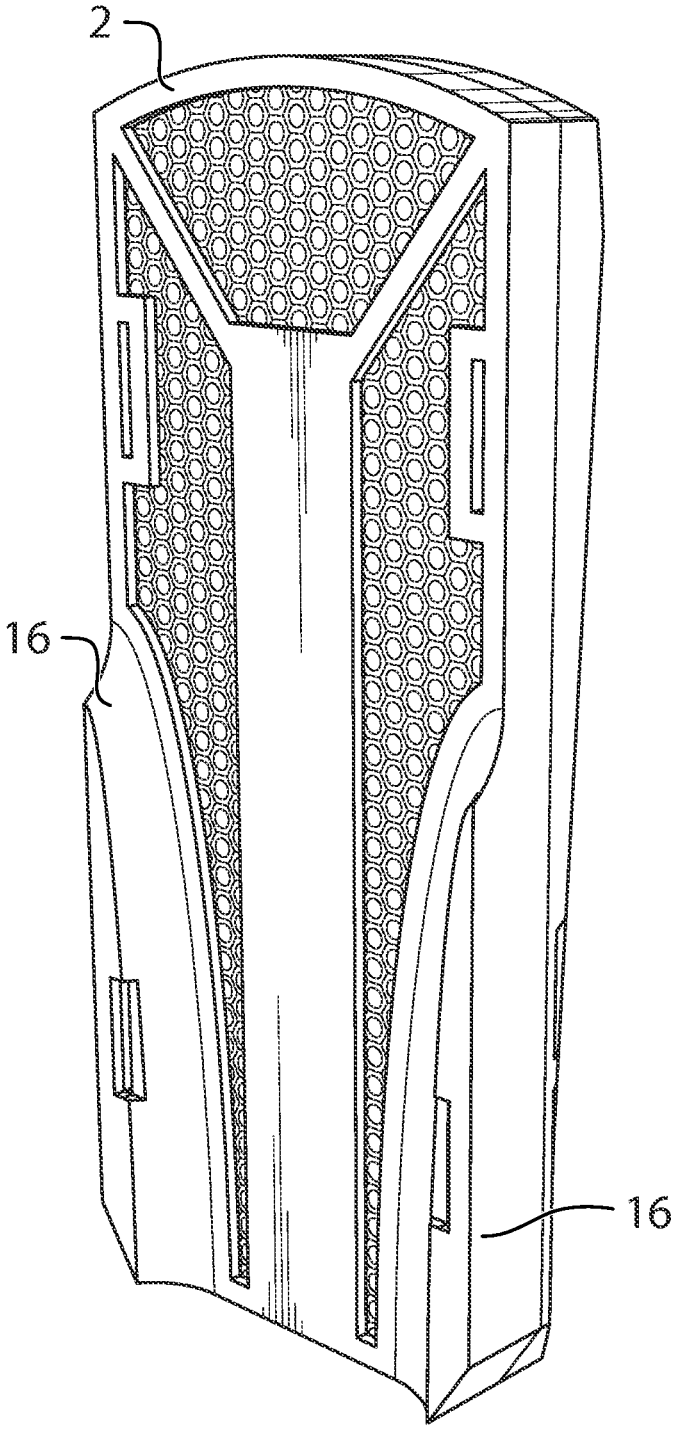
FIG. 13 is a front perspective view of an alternate embodiment of an arm support of the invention.
Figure 14:
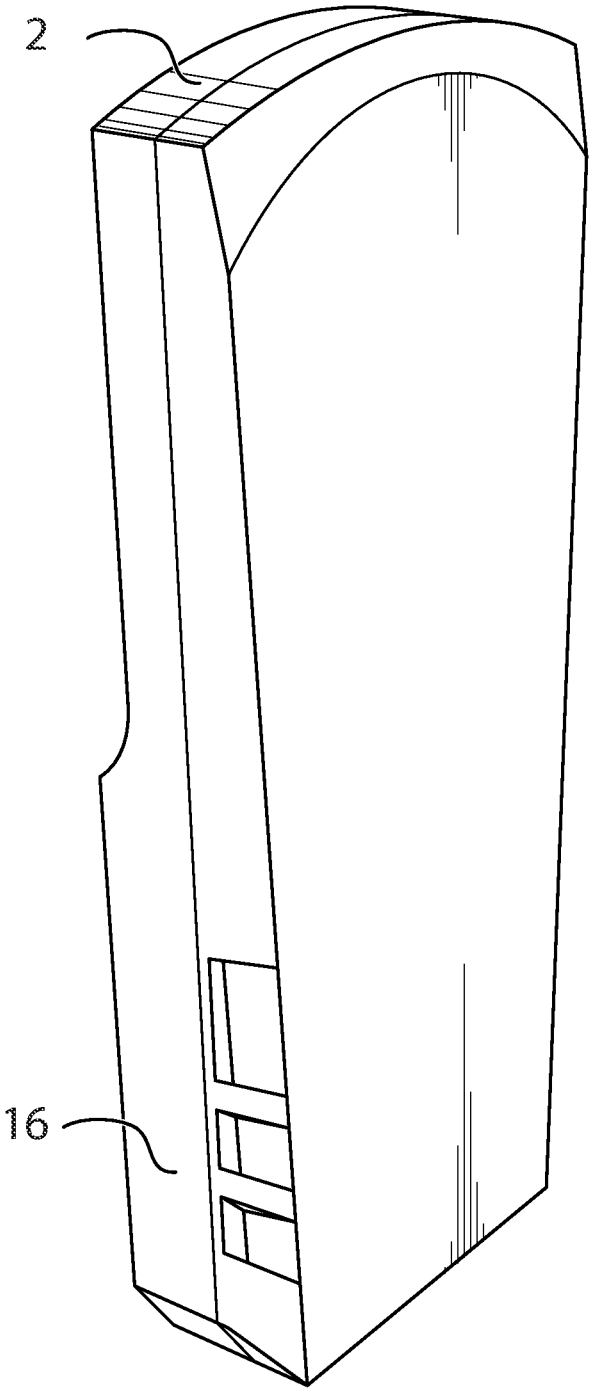
FIG. 14 is a rear perspective view of an alternate embodiment of an arm support of the invention.

An alternate embodiment of the invention, having lateral arm support walls 16, is shown in FIGS. 13 and 14.

Figure 7:
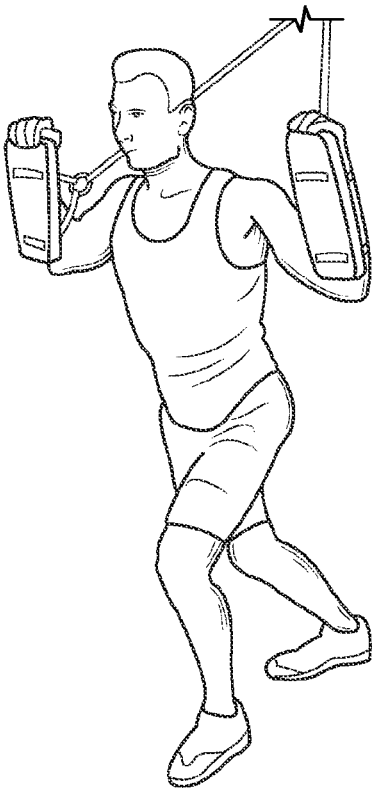
FIG. 7 depicts use of the apparatus of the present invention in a pecs exercise in an eccentric contraction starting horizontal plane position.
Figure 8:
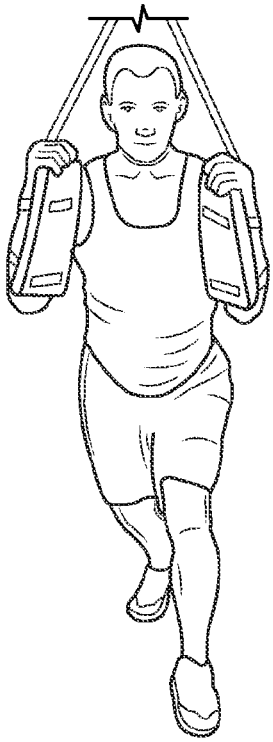
FIG. 8 depicts use of the apparatus of the present invention in a pecs exercise in a partial isokinetic contraction midway position.
Figure 9:
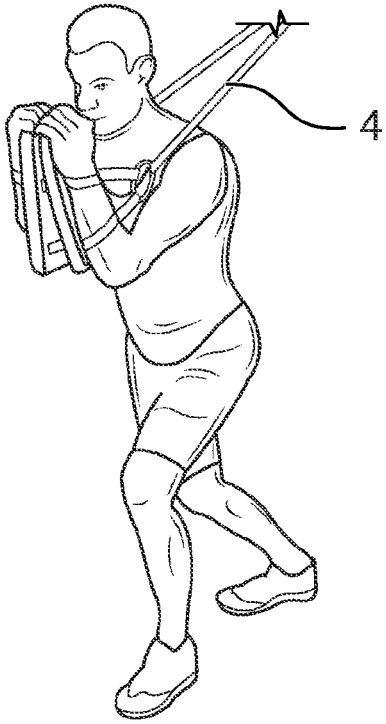
FIG. 9 depicts use of the apparatus of the present invention in a pecs exercise in a full isokinetic contraction concentric position.

In operation, as depicted in FIGS. 7 to 9, a pectoral exercise may be carried out by securely attaching the elastic cord or cords approximately 80" from the ground. Other heights are also possible, depending on the height of the user. The strapping of the arm supports may then be attached through the connection means to the end of the elastic cord or cords. The user places the forearms into the arm supports and firmly grips the top of the arm supports with the fingers while in the eccentric contraction. The user stands with the back to the anchored cord at a desired distance selected to obtain the desired resistance. Placing one bent leg forward with the rear leg on its plantar flexion, the arms are extended out to the sides with elbows bent 90°, mimicking a prior art pec deck as depicted in FIG. 1. Both arms are then drawn together along an arc until the arm supports are touching. Preferably, the user will tighten the chest muscles at the end of the concentric phase for maximum stimulation of the inner area of the chest muscles. Finally, the user draws the elbows back outwardly along the arc to return the arm supports to the side positions. The movement may then be repeated from the starting horizontal plane position for a desired number of repetitions.

Apart from development of the pectoral muscles, the apparatus of the present invention may be used to develop the muscles of the core. The core is the foundation of the human body. It is comprised of the muscles that span the hips, abdominals, back and shoulders. For every move from lifting a heavy box to swinging a bat, the core needs support. Developing a stronger core starts with rethinking the crunch. The effectiveness of hundreds of crunches on the ground is questionable. Rather, core exercises should engage the user's stabilizer muscles and challenge their balance.

Figure 10:
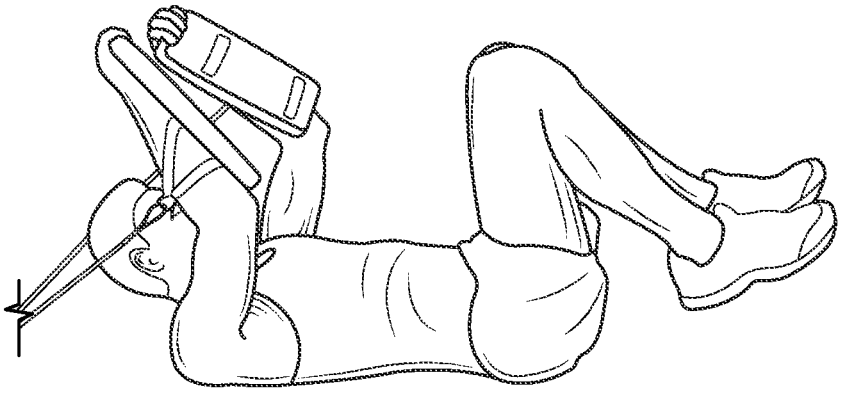
FIG. 10 depicts use of the apparatus of the present invention in an abdominals exercise in an extended position with legs bent.
Figure 11:
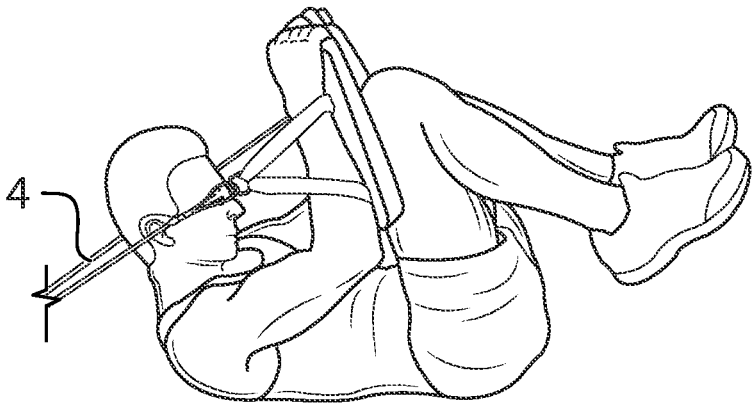
FIG. 11 depicts use of the apparatus of the present invention in an abdominals exercise in an fully contracted position with legs bent.
Figure 12:
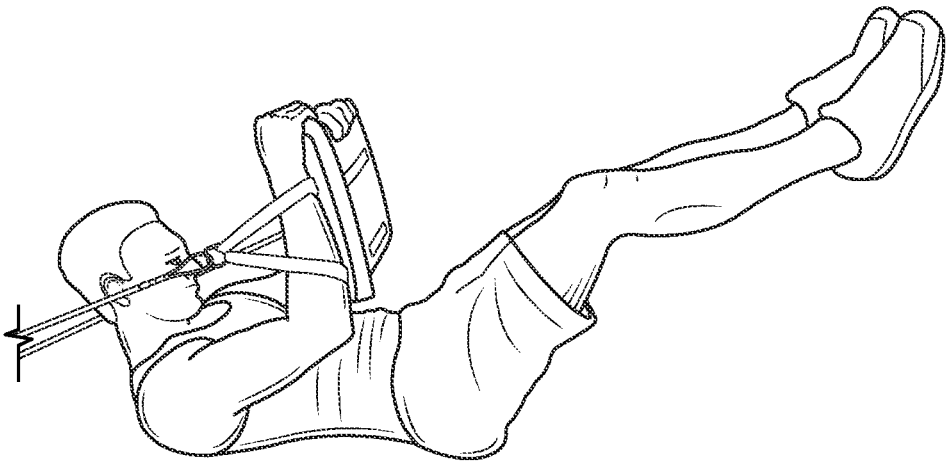
FIG. 12 depicts use of the apparatus of the present invention in an abdominals exercise in a partially contracted position with legs raised.

Such core workouts may incorporate the apparatus of the present invention for an added challenge. As shown in FIGS. 10 to 12, the present apparatus may easily be used to help strengthen and shape the mid section. FIG. 10 shows a user in a supine position with the elastic cord fixed from behind. Arms are raised above the head and slightly bent. Hands are still firmly grasping the top of the arm supports. Feet may be raised or flat on the floor. The user then contracts the abdominal muscles and bends forward slowly, raising the shoulders slightly off the ground until their body is at a 45 degree angle, as depicted in FIG. 11. At an intermediate level, the user may lift the legs off the ground straight in front, as shown in FIG. 12.

From the foregoing, it will be seen that this invention is one well adapted to attain all of the ends and objectives herein set forth, together with other advantages which are obvious and which are inherent to the apparatus. It will be understood that certain features and sub-combinations are of utility and may be employed with reference to other features and sub-combinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense. It will be appreciated by those skilled in the art that other variations of the preferred embodiment may also be practiced without departing from the scope of the invention.

The invention claimed is:

1. An exercise apparatus comprising:

an anchor for attachment to an anchor point;

first and second elastomeric cords, each attachable at a first end to the anchor;

first and second planar arm supports, each planar arm support attachable to a second end of a corresponding elastomeric cord, wherein each arm support further comprises gripping means for allowing a user to clasp the arm support with a hand; and one or more adjustable straps attachable to each planar support for securing one or more arms of a user to the planar arm support.

2. The exercise apparatus of claim 1, wherein the gripping means comprise an opening for insertion therethrough of the user's fingers.

3. The exercise apparatus of claim 1, wherein the gripping means comprise a handle.

4. A portable exercise apparatus comprising:

one or more planar arm supports for supporting one or both of a user's forearms;

one or more straps for securing each arm support to the user's forearms;

one or more elastomeric cords attachable between each planar arm support and one or more anchor points, wherein each elastomeric cord is attached to an arm support by connection to the corresponding straps; and an anchor for securing each elastomeric cord to the anchor points.

* * * * *